US005931506A

United States Patent [19]

Lo

[11] Patent Number: 5,931,506

[45] Date of Patent: Aug. 3, 1999

[54] RING BINDERS

[75] Inventor: Kenneth K. L. Lo, Kwai Chung, The Hong Kong Special Administrative Region of the People's Republic of China

[73] Assignee: The Coronet Paper Co. Ltd., The Hong Kong Special Administrative Region of the People's Republic of China

[21] Appl. No.: 08/693,212

[22] PCT Filed: Dec. 30, 1994

[86] PCT No.: PCT/GB94/02830

§ 371 Date: Oct. 1, 1996

§ 102(e) Date: Oct. 1, 1996

[87] PCT Pub. No.: WO95/21062

PCT Pub. Date: Aug. 10, 1995

[30] Foreign Application Priority Data

Feb. 7, 1994 [GB] United Kingdom ..... 9402302

[51] Int. Cl.[6] ..... B42D 3/00

[52] U.S. Cl. ..... 281/37; 281/29; 402/73

[58] Field of Search ..... 281/29, 36, 37, 281/28, 51; 402/73, 70, 57

[56] References Cited

U.S. PATENT DOCUMENTS 5,213,368 5/1993 Wyant ..... 281/36 X 5,607,246 3/1997 Podosek ..... 281/36 X

*Primary Examiner*—Willmon Fridie, Jr.

*Attorney, Agent, or Firm*—Miller, Sisson, Chapman & Nash, P.C.

[57] ABSTRACT

A folder comprising an upper cover for a ring binder has a lip 13 which is arranged to fit into a normal ring binder press. The lip and a bundle of sheets can then be formed with slots to receive the ring binder in conventional manner. The lower cover 10 has a fold line 14 to allow it to remain free of the press and to wrap around the ring binder and cover the bundle of sheets. The folder itself has no holes in it and can be formed of virtually any material.

4 Claims, 1 Drawing Sheet

RING BINDERS

The invention relates to ring binders and the like.

Ring binders are commonly used in offices and elsewhere for use in pamphlets, booklets, bundles of papers and so on. A bundle of pages is held together at its one side by plastic rings which form a hinge so that the pages can be turned one at a time about the hinge.

Ring binders which are generally available are normally inserted using a manually operated press into which the one sides of the pages are inserted and aligned together as a bundle. The press grips the pages and when operated punches holes along and adjacent the one side for accommodating the plastic rings. The press is then opened and the plastic rings, normally held together by an integrally formed linking member, are inserted into the punched out holes.

So called "ring binders" may also use a spiral wire hinge or a simple clamping arrangement which holds the one sides of the pages together. Such a clamping arrangement can consist of a strip of plastic at each side of the bundle which extend adjacent and along the one side of the pages. The strips are held together by rivets or other connectors which pass through apertures in the pages normally formed by the press.

In this specification we therefore use the term "ring binder" to mean all forms for binding of bundles of sheets of material (usually paper or plastic) to keep them together along one side. The sheets are held by plastic or metal pieces which pass through holes in the one sides of the sheets and allow the sheets to be turned in a manner similar to the pages of a book.

At present ring binders suffer from the disadvantages that the outer appearance cannot be particularly aesthetic, that the rings (or similar) can easily catch against and engage each other, from one ring binder to another, and that other objects and articles in a general office environment, for example, can become easily entwined with the exposed ring binder.

It is an object of the invention to overcome or at least reduce this problem by providing a convenient folder or outer cover for a ring binder.

According to the invention there is provided a folder comprising an upper cover and a lower cover for a ring binder arranged to surround the ring binder and to lie over an upper and lower face of a bundle of sheets of material held by the ring binder, in which the lower cover has a lip at one side which extends towards the ring binder and away from which the lower cover is arranged to fold to allow the lip to enter a binding press and be punched through in use with the rest of the sheets.

The folder may extend to cover the whole of the upper and lower surface and the lip provided on a sheet of material fixed over an inside of the lower cover except for a small region to form the lip. Alternatively, the lip may be formed by one side of a strip of material fixed along adjacent its other side to the inside of the lower cover.

A narrow strip of material may be attached centrally where the upper and lower cover meet to the inside of the folder to extend in use along the outside of the ring binder. The strip of material may have an exposed sticky surface which sticks to the ring binder to hold the folder against the ring binder.

A folder for a ring binder will now be described by way of example with reference to the accompanying diagrammatic drawings in which.

Figure 1:
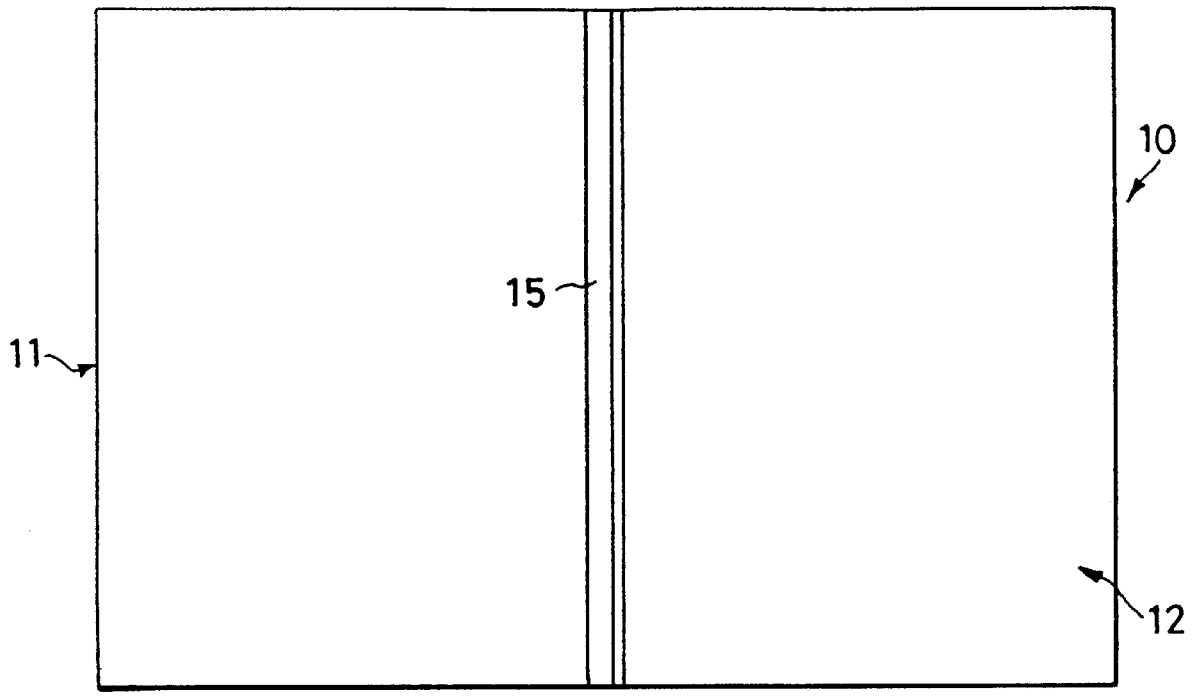
FIG. 1 is an inside plan view of the folder.
Figure 2:
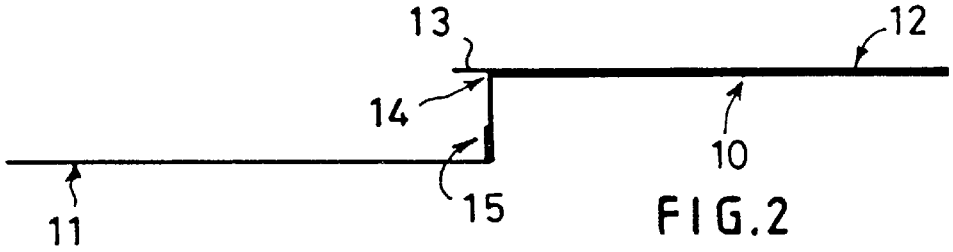
FIG. 2 is a side view of the folder.
Figure 3:
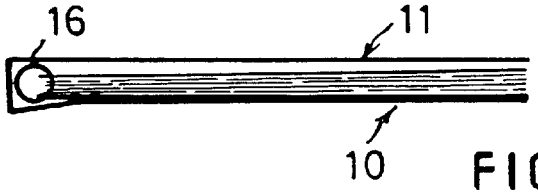
FIG. 3 is a side view the folder enclosing a bundle of pages.
Figure 4:
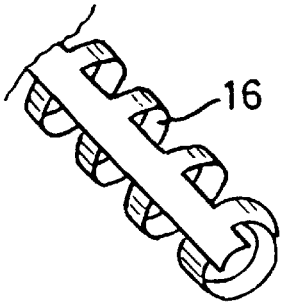
FIG. 4 is an enlarged isometric partial view of a ring binder.

Referring to the drawing, the folder has a lower cover 10 (which normally forms the back of a bound bundle of pages) and an upper cover 11. The lower cover 10 has a sheet of cardboard 12 stuck to its inner surface except along one end where, as shown in FIG. 2, it forms a lip 13 which extends beyond a fold line 14 of the lower cover. A narrow strip of double sided sticky tape 15 is attached to the inside of the folder to lie in use opposite a ring binder 16 (which has conventional configuration best shown in FIG. 4). Normally, the folder is made and supplied with a non-sticky cover over the tape 15 which is removed only when the folder is first fitted around a bundle of pages (as shown in FIG. 3).

In use, a bundle of papers are placed on top of the lower cover 10 and aligned along their one sides with the edge of the lip 13. The lower cover 10 is folded back about the fold line 14 to allow the lip and the bundle of papers to enter the jaws of a ring binder press and be punched through to provide holes for the ring binder 16. Such an operation is in itself well-known, as well as then fitting the ring binder. The upper cover 12 is then placed over the upper face of the bundle to surround the ring binder 16. The strip 15 contacts the outer surface of the ring binder and holds the folder in contact therewith.

Normally, the lower cover 10 of the folder extends in use to cover over the whole of the lower surface of the bundle of pages. However, the folder could be formed to extend over only a part of that surface. In such a case, the lower cover 10 is stuck or otherwise attached to the cardboard 12 along and behind the lip 13. In other words, the lower cover could extend only so far as is required to form a suitable secure attachment to the cardboard 12, but allowing the lip 13 to be free to fit a ring binding press as required.

In an alternative arrangement, the lip 13 is formed by a relatively narrow strip of material attached to a lower cover 10, which cover then extends as shown or at least far enough to form a rear or bottom cover for the bundle of sheets. This narrow strip is then fixed along adjacent one of its edges and is positioned so that its other edge provides the lip 13.

A wide range of materials can be used for the folder, the only restriction is that whatever material is provided to form the lip must be suitable to have holes or slots punched in it by the ring binder press and not to fracture or break up as a result of having such holes punched out. Generally stated, the folders can therefore be provided in materials of wide choice to satisfy both functions and aesthetics. Importantly, when the folders are in use to cover the ring binder and make up files, pamphlets or whatever, these articles can be more attractive visually, easier to handle and to stack, and the rings are prevented from catching each other or other items or articles on a desk top, for example.

It will be appreciated that because the described folders, which forms the outer cover of the bundle of papers are not holed, as would be the case in the prior art, the ring bound bundles is also more securely and effectively enclosed.

I claim:

1. A folder for a ring binder for use in combination with a binding press for binding a bundle of sheets of material, comprising:

an upper cover and a lower cover arranged to surround said ring binder and to lie over an upper and lower face respectively of said bundle of sheets of material within said ring binder;

a protruding lip member extending laterally across and anchored to said lower cover adjacent said ring binder, said lower cover arranged to fold towards said ring binder to allow an edge of said protruding lip member to enter said binding press and align with edges of said sheets of material, said edge of said protruding lip punchable through said sheets by said binding press without said folder fitted to surround said bundle.

2. A folder according to claim 1, in which said folder covers the entire surface of said upper and lower faces; and said lip member is an edge of a sheet of material fixed over a substantial area of an inside surface of said lower cover.

3. A folder according to claim 1, in which a narrow strip of material extends laterally across an inside surface of said folder opposite said ring binder.

4. A folder according to claim 3, in which said strip of material has an exposed sticky surface which sticks to said ring binder in use to hold said folder against said ring binder.

* * * * *